US005633835A

United States Patent [19]

Haas et al.

[11] Patent Number: 5,633,835

[45] Date of Patent: May 27, 1997

[54] LONG TERM RAPID COLOR CHANGING TIME INDICATOR

[75] Inventors: David J. Haas; Sandra F. Haas, both of Suffern, N.Y.

[73] Assignee: Temtec, Inc., Suffern, N.Y.

[21] Appl. No.: 197,631

[22] Filed: Feb. 10, 1994

Related U.S. Application Data

[63] Continuation-in-part of Ser. No. 45,552, Apr. 9, 1993, Ser. No. 955,469, Oct. 2, 1992, and Ser. No. 771,765, Oct. 4, 1991, said Ser. No. 955,469, and Ser. No. 771,765, each is a continuation-in-part of Ser. No.602,120, Oct. 22, 1990, which is a continuation-in-part of Ser. No. 460,753, Jan. 4, 1990, Pat. No. 5,058,088, said Ser. No. 45,552, is a continuation-in-part of Ser. No. 650,221, Feb. 4, 1991.

[51] Int. Cl.[6] ..... G04B 17/00

[52] U.S. Cl. ..... 368/327; 116/200

[58] Field of Search ..... 368/327; 116/200, 116/207, 219

[56] References Cited

U.S. PATENT DOCUMENTS

| | | | |
|---|---|---|---|
| 2,088,567 | 8/1937 | Ballou | 283/96 |
| 3,999,946 | 12/1976 | Patel et al. | 23/258 |
| 4,212,153 | 7/1980 | Kydonieus et al. | 368/62 |
| 4,292,916 | 10/1981 | Bradley et al. | 368/89 |
| 4,408,557 | 10/1983 | Bradley et al. | 368/327 |
| 4,432,630 | 2/1984 | Haas | 283/114 |
| 4,573,711 | 3/1986 | Hyde | 283/98 |
| 4,643,122 | 2/1987 | Seybold | 116/206 |
| 4,812,053 | 3/1989 | Bhattacharjee | 374/102 |
| 4,846,502 | 7/1989 | Chang et al. | 283/96 X |
| 4,903,254 | 2/1990 | Haas | 110/200 X |
| 4,987,849 | 1/1991 | Sherman | 116/200 X |
| 5,058,088 | 10/1991 | Haas et al. | 368/327 |
| 5,107,470 | 4/1992 | Pedicano et al. | 368/327 |

FOREIGN PATENT DOCUMENTS

WO9106853 5/1991 WIPO .

OTHER PUBLICATIONS

Supplementary European Search Report, Communication and Claims of Foreign Application as Submitted to us by Foreign Associate.

*Primary Examiner*—Bernard Roskoski
*Attorney, Agent, or Firm*—Michael E. Zall

[57] ABSTRACT

A time indicator that rapidly changes color after a specific time interval is provided. The time indicator includes a base substrate with colored dye deposited on a first surface; a barrier applied over the colored dye; and a substrate having an adhesive on a first surface thereof. The substrate and the base substrate are put into adhesive contact. The adhesive coacts with the barrier to dissolve the barrier in a specified time interval. The adhesive then contacts the colored dye to dissolve the dye and permit the dye to migrate through the adhesive to cause a color change visible through the substrate.

24 Claims, 4 Drawing Sheets

LONG TERM RAPID COLOR CHANGING TIME INDICATOR

This application is a CIP of application Ser. No. 08/045,552 filed Apr. 9, 1993; which is a CIP of application Ser. No. 07/650,221 filed Feb. 4, 1991; said application Ser. No. 08/197,631 filed Feb. 10, 1994 is a CIP of application Ser. No. 07/955,469 filed Oct. 2, 1992, and a CIP of application Ser. No. 07/771,765 filed Oct. 4, 1991; said application Ser. No. 07/955,469 filed Oct. 2, 1992 is a CIP of application Ser. No. 07/602,120 filed Oct. 22, 1990; said application Ser. No. 7/771,765 filed Oct. 4, 1991 is a CIP of application Ser. No. 07/602,120 filed Oct. 22, 1990 which is a CIP of application Ser. No. 07/460,753 filed Jan. 4, 1990 now U.S. Pat. No. 5,058,088.

BACKGROUND OF THE INVENTION

1. Field of the Invention

The present invention relates to a time indicator for indicating the passage of a relative amount of time, and in particular, to a time indicator for indicating the passage of a relatively long amount of time which indicator shows such passage of time by a rapid color change or color switch to clearly show the end of the time interval.

2. Description of the Prior Art

Simple film and paper time indicators are currently being manufactured employing two technologies, one is an opaque film technology which employs dyes diffusing through an opaque film, and the second is a clear film technology which employs a dot pattern of permanent pigment dyes and migrating dyes such that as the migrating dye dots enlarge in size, they develop out a visible image.

Both of these technologies are covered in U.S. Pat. Nos. 4,903,254 dated Feb. 20, 1990, and U.S. Pat. No. 5,058,088 dated Oct. 15, 1991 to David J. Haas, the entire disclosures of which are incorporated herein by reference. These indicators are useful for indicating the passage of relatively short time intervals such as days or weeks. They are not useful for longer time intervals such as months or years because the color change occurs by dye diffusion which begins the instant the activator is applied over the printed dyes. Even though the dye may migrate very slow, these technologies present a problem for the observer in identifying exactly when the image or color change indicates the time interval has occurred.

The prior work in this area has yet to solve the problem of accurately (instantaneously) indicating the passage of a relatively long time interval. Previous efforts are as follows:

U.S. Pat. No. 3,018,611 to Biritz describes a time indicator device which may be used for frozen foods, parking times, construction periods, etc. The device comprises a backing which is attachable to the outer surface of, for example, a package of frozen food. Superimposed on the backing is a strip of filter paper having a chemical reagent laminated thereto. The chemical reagent is an oxygen reactive material. The strip is hermetically sealed by a covering of transparent, impervious pressure sensitive cellophane which allows visual inspection of the oxygen reactive layer. A pin-hole size opening is provided in the covering to allow for ingress of air within the interior of the container. This opening is sealed by a removable tape. When the tape is removed the oxygen reactive material reacts to change color by permitting air to enter and diffuse into the container to make contact with the material. The pin-hole opening is provided at one end of the container and as time proceeds, the color proceeds toward the other unexposed end of the container.

U.S. Pat. No. 3,520,124 to Myers, describes a parked car time indicator which includes a first sheet having a first reactant and a second sheet having a second reactant, and a release sheet, which is peeled away to permit contact of the first sheet with the second sheet to start a reaction over a selective time interval terminating with a color change of the reactants.

U.S. Pat. No. 3,480,402 to Jackson, describes a time indicator formed of an absorbent carrier having absorbed thereon at least one chemical compound which changes color upon exposure to oxygen. The carrier and chemical compound absorbed thereon are protected from ambient oxygen by a non-perforated barrier layer which is transparent and through which atmospheric oxygen can controllably diffuse over a preselected period of time. Thus, when the chemical compound changes color, the preselected period of time is indicated. The graduated time indicator may be produced by utilizing more than one chemical or a layer covering the various pieces of absorbent material of different thickness. For each piece of absorbent material, the chemical absorbed on the piece of absorbent material would change color at different times, e.g., the chemical on one piece would change color after, say, one week, and the chemical absorbed on another piece would change color after ten days, and the chemical on a further piece of absorbent material would change color after fourteen days. Thus, a graduated time indicator is described.

U.S. Pat. Nos. 3,954,011 and 3,962,920 to Manske, describes a time indicating device suitable for visibly measuring parameters such as time, temperature and time-temperature relationships. The device includes a porous fluid-carrying pad, a wick material for said fluid and an indicator means whereby the progress of fluid along the wick material can be visibly indicated and used to measure the passage of time, the exposure to a given minimum temperature or time-temperature relationship.

U.S. Pat. No. 4,028,876 to Delatorre describes an apparatus for visually indicating elapsed time by a color change which comprises a transparent container having a rupturable capsule therein and in which a first composition is contained. A transparent matrix surrounds the second composition which is also in the container. The device may be secured to a surface by means of a mechanical fastener or an adhesive layer.

U.S. Pat. No. 4,212,153 to Kydonieus, et al describes a laminated indicator which changes in a visually perceptible mode with the passage of time. The indicator comprises at least two layers whereby the molecular migration of an agent in an interior layer to the outermost surface of the exterior layer causes a change which is visually perceptible. This reference also describes the use of a step-wedge test color panel placed next to the indicator which is used to compare the developed color or shade. The step-wedge can be provided with indicia corresponding to the time period required to develop the color at each step of the wedge.

Attention is also drawn to U.S. Pat. No. 4,903,254, which is an improvement of the aforementioned Kydonieus et al. patent. It provides a time indicator badge which provides a clear indication of the expiration of time.

U.S. Pat. No. 4,229,813 to Lilly, et al describes a time indicator which utilizes a silicon oil which is slowly absorbed onto and moves up a porous strip at a rate which is a function of time. One side of the strip is printed with an oil soluble ink, while the other side is unprinted. The printed side of the strip is laminated with polyethylene film to an unprinted strip. As the silicon oil moves up the strip, the oil contacts the ink causing a dye in the ink to migrate from the printed side to the unprinted side, thus providing a measurable color front moving up the strip.

U.S. Pat. No. 4,382,700 to Youngren describes an indicator which contains a mineral jelly which is in contact with a wick, such that the mineral jelly diffuses into the paper in accordance with the changes in ambient temperature over a period of time.

U.S. Pat. No. 4,408,557 to Bradley, et al describes a timer comprising an absorptive layer disposed on a base layer which accepts a carrier mixture at a predetermined rate. A barrier means is disposed between the carrier mixture and the absorptive layer, and the removal of the barrier activates the timer.

U.S. Pat. No. 4,629,330 to Nichols describes a color change indicator which includes a liquid having a predetermined index of refraction and a rate of evaporation, a reservoir for holding liquid, and an opacifying layer of microporous material. The opacifying layer has an index of refraction approximately the same as that of a liquid and overlies the reservoir. The opacifying layer has an open cell network of pores for absorbing liquid from the reservoir and is in a first radiation scattering condition when the liquid occupies the opacifying layer, and in a second scattering condition when the liquid is depleted from the opacifying layer.

U.S. Pat. No. 4,643,122 to Seybold describes a diffusion controlled security tag comprising a carrier containing a solution of a compound which changes color upon diffusion or evaporation of the solvent. The carrier is enveloped in a barrier film which controls the rate of diffusion/evaporation of the solvent from the carrier, such that a change in color of the carrier indicates undesirable storage or product tampering.

U.S. Pat. No. 5,107,470 to Pedicano, et al. discloses an indicator wherein a migrating ink bleeds through an opaque layer where it can be seen. The Pedicano device has a base portion and an indicator portion. The base portion includes a clear impermeable base coated onto a non-curing coating having a release sheet. The clear impermeable base carries printed ink, a portion of which contains a migrating agent. The indicator layer includes a clear impermeable top layer, a non-curing indicator layer coating and an indicator release sheet. The non-curing indicator layer coating, upon activation of the indicator, is exposed to and put into adhering contact with base layer to contact the printed ink. Indicator layer is preferably an opaque plasticizer-vinyl-titanium dioxide mixture. This opaque layer provides a background for message display and obscures the non-migrating camouflage component of the printed ink.

One of the problems associated with all of the foregoing devices is that they are difficult to adjust for a selected period of time. Adjustment often involves experimentation with many types of inks, solvents, wicks, etc. to prepare a device which can operate under the conditions expected. Additionally, very few of these devices can indicate the relative length of time that has elapsed since the device was activated, i.e., it is difficult to determine what fraction of the selected period of time has elapsed. Further, none of these devices are suitable for measuring a relative long time period. Most of the prior art devices gradually change color over a relatively short period of time and involve, at best, a guess on how much time has elapsed. When this is combined with the possible variations in temperature, humidity, etc. that may exist in the environment of the time indicator, the viewer has very little confidence that he is close to the expiration time of the device.

None of these references teach or suggest the applicant's claimed invention. Applicant, with its invention has met a need that exists for an indicator which is inexpensive and can clearly, relatively accurately and quickly indicate the passage of relatively long time intervals.

OBJECTS AND SUMMARY OF THE INVENTION

It is an object of this invention to provide a time indicator device which can provide the user with a clear indication of the passage of relatively long time intervals.

It is a further object of this invention to provide a time indicator device wherein the means for adjusting the selected period of time of the device can be easily and simply adjusted.

It is still a further object of this inventions to provide a time indicator for accurately indicating the passage of long periods of time, including months and even years.

It is another object of the present invention to provide a time indicator in which the dye cannot be seen and/or does not start migrating until the end of a time interval.

It is still another object of this invention to provide a time indicator that remains unchanged until near the end of the specified time interval.

It is an additional object of the present invention to provide a time indicator wherein the color changes rapidly to indicate the passage of the specified time period.

It is a further object of the present invention to provide a time indicator that eliminates the problem of gradual color changes.

The present invention is directed to providing a time indicator having a dissolvable barrier which prevents contact of the ink with the activator until after the barrier is dissolved.

The time indicator of the present invention has a dissolvable barrier means for separating the migrating dye from the activation layer. This invention works with the use of time indicators employing opaque films or opaque adhesives, as well as with time indicators employing a clear film and printed dots of permanent and migrating inks. Importantly, the dissolvable barrier of the present invention is placed over the migrating inks or dyes and protects the migrating inks or dyes from the activation layer for a long period of time. The activation layer contains dissolver that dissolves the barrier of a time period. Thus, no color change occurs for the majority of the time interval because the ink or dye does not bleed or migrate because it does not touch the activation layer until after the barrier is penetrated. When the dissolver in the activation layer does breach the barrier, the activation layer coacts with the migrating ink or dye, causing the ink or dye to rapidly dissolve into the activation layer to cause a rapid color change.

The present invention provides a time indicator that rapidly changes color after a specific time interval comprising: a base substrate with colored dye deposited on a first surface; a barrier applied over the colored dye; and a substrate having an adhesive on a first surface thereof; wherein the substrate and the base substrate are put into adhesive contact, the adhesive coacts with the barrier to dissolve the barrier in a specified time interval, the adhesive then contacts the colored dye to dissolve the dye and permit the dye to migrate through the adhesive to cause a color change visible through the substrate.

BRIEF DESCRIPTION OF THE DRAWINGS

For a more complete understanding of the present invention, reference may be had to the following description of an exemplary embodiment of the present invention considered in connection with the accompanying drawings, in which.

DETAILED DESCRIPTION OF THE INVENTION

Figure 1:
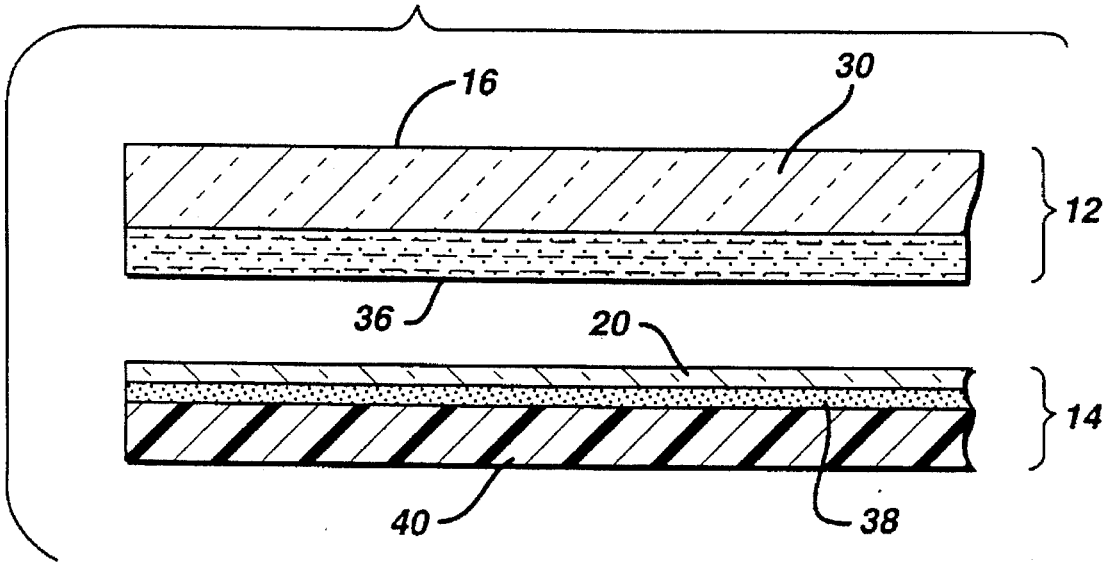
FIG. 1 is a cross-sectional view of the time indicator of the present view prior to activation.
Figure 2:
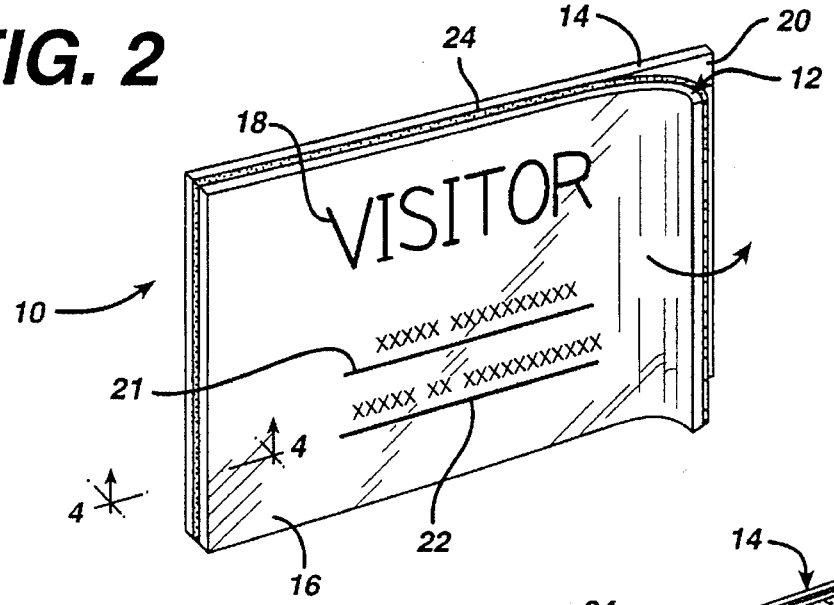
FIG. 2 is a perspective view of a time indicator badge according to the present invention.
Figure 3:
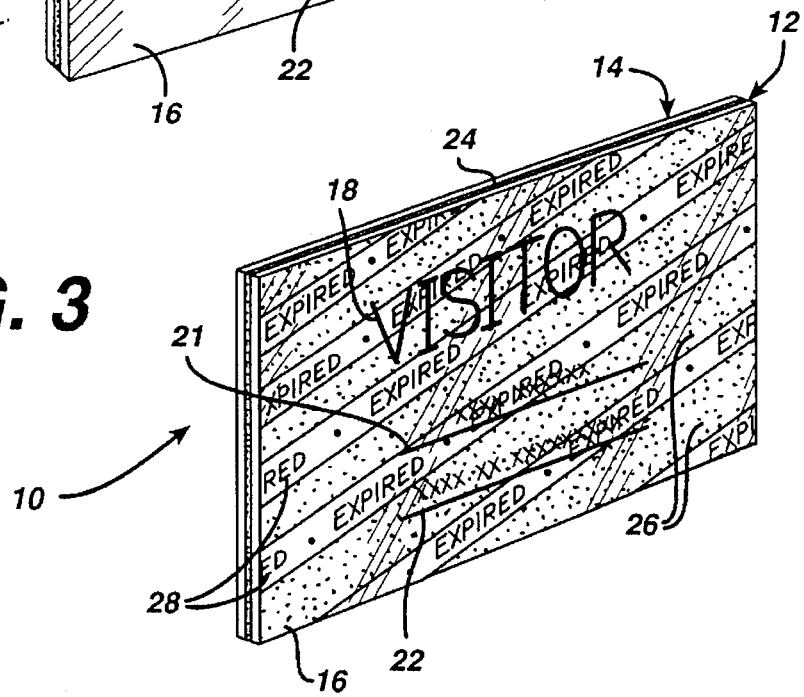
FIG. 3 is a perspective view of the time indicator badge of FIG. 1 after the expiration thereof.

As shown in FIG. 1, the time indicator of the present invention, generally indicated at 10, is provided in two parts: the front part 12, and the back part 14. The front part 12 includes a substrate 30 which may be clear or opaque depending on the type of indicator being used. It includes a support film, which may be an acetate or polyester film, having display surface 16 and a pressure sensitive layer, i.e. adhesive 36, attached to one side thereof. An organic liquid such as a plasticizer may be dissolved in the pressure sensitive adhesive 36.

The back part 14 of the time indicator 10 of the present invention includes a support surface 40 and, on one side thereof, a migrating ink or dye 38. Placed over the migrating ink or dye is a barrier coating or film 20. Upon activation of the time indicator of this invention, the first part 12 is put into contact with the second substrate 14, the adhesive 36 contacting the barrier film 20. The organic liquid in the adhesive 36 contacts the barrier layer 20 on the second substrate 14 and dissolves the barrier layer 20 over a period of time. After dissolving the barrier layer 20, the organic liquid contacts the migrating ink or dye to rapidly dissolve the ink or dye to produce a rapid color change.

One may begin the timing process by simply applying the front part 12 onto the back part 14. The adhesive 36 on the front part 12 adheres the back part 14. Upon contact, the organic liquid in the adhesive 38 slowly begins to dissolve the barrier coating or film 20 over the dye layer 38. After a specific time interval, the barrier layer 20 become porous and the dye 38 dissolves into the adhesive 36 on the front part 12. This dye dissolving event is very rapid, in the order of minutes to hours. Thus, color or image appearance signals the end of the time interval and hence, that the time indicator has performed its task.

As shown in FIGS. 2–5, a time indicator badge for use by a visitor to a facility, which expires after a specific time interval, is generally indicated as 10. The badge 10 comprises a front part 12 and a back portion 14 having stripes printed with ink 38 that migrates through the front portion 12. When a badge 10 is issued, the adhesive 36 on the front portion 12 is placed over the backpart 14 to begin the timing process. The organic compound in the activator adhesive 36 acts on the dissolvable film 20 to begin dissolving the film. After a selected time interval, the film is breached and the ink 38 passes or migrates through the badge to the front portion 12 whereupon the printed stripes become visible, thus alerting a guard or other security personnel that the badge has expired.

On the front part 12 of the badge 10 is a front print display surface 16, which has the word "VISITOR" or other such terminology printed thereon. It may include a visitor name line 21 whereon the security person can write the name of the visitor. The badge may also include other information. After the barrier 20 is breached and the ink migrates to the front surface, a plurality of diagonal voiding bars 26 and a plurality of "EXPIRED" notice words 28 are displayed through the print display surface 16.

Figure 4:
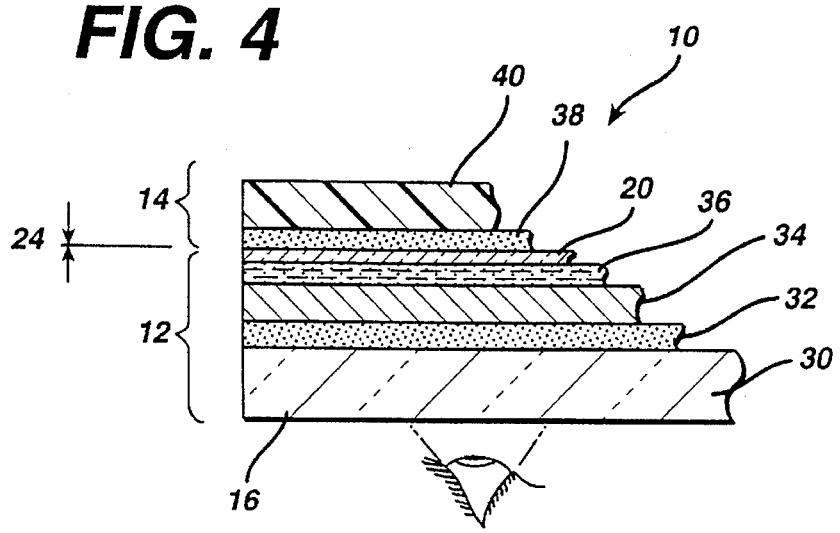
FIG. 4 is a cross-sectional view of the time indicator of FIG. 2.

As shown in FIG. 4, the front part 12 has overlaying each other a transparent front support layer or clear plastic sheet 30, an adhesive and ink display layer 32, a white or opaque layer 34 and an adhesive ink dissolver 36. Layer 32, 34, and 36 can be multiple, discrete layers, or can be combined into one layer.

Transparent layer 30 is an impervious external support layer which is composed of an acetate film or polyester film. Adhesive and ink display layer 32 is supported by transparent layer 30. Opaque layer 34 is supported by adhesive and ink display layer 32 and acts as an optical barrier. An adhesive and ink dissolver 36 is supported by the display layer 32.

The rear part 14 has a migrating red ink patterned film or layer 38 and has a support card 40. The ink layer 38 is loosened and dissolved by an adhesive and ink dissolver layer 36 after the front part 12 is joined to the rear part 14 along assembly joint 24. The ink pattern layer 38 is dissolved and then travels or migrates through layers 36, 34 and 32 to an ink display surface 42, on the layer 32.

When the badge 10 is issued, the self-adhesive front part 12 is placed over the rear part 14 and the time process begins. In this embodiment, badge 10 is a one-month badge and has a length of about three inches and a width of about two inches and a thickness of less than one-eighth inches. To issue badge 10, the desired data is filled out on the front surface 16 a release paper is pealed off the front part 12, and front part 12 is placed over rear part 14. The red indicator marks 26 and the expiration words 28 appear after expiration of the approximate time period.

Transparent layer 30, which is a clear inert acetate film, has a selected thickness. Layer 30 provide mechanical support and rigidity, and supports adhesive and ink display layer 32. Transparent layer 30 also prevents passage of foreign inks or dyes front entering into layer 30 through the front print surface 16 of layer 30. Opaque film 34 is thin to provide a relatively short travel path for the migrating ink to permit it to pass rapidly therethrough to prevent dispersion.

Adhesive and ink display layer 32 absorbs the patterned ink after the patterned ink migrates through layer 34.

Varying time periods for the expiration of the time badges 10 may be controlled by the thickness and composition of the barrier film 20. Further, the time period may be controlled by varying the concentration of the organic compound in the adhesive layer 36.

Figure 5:
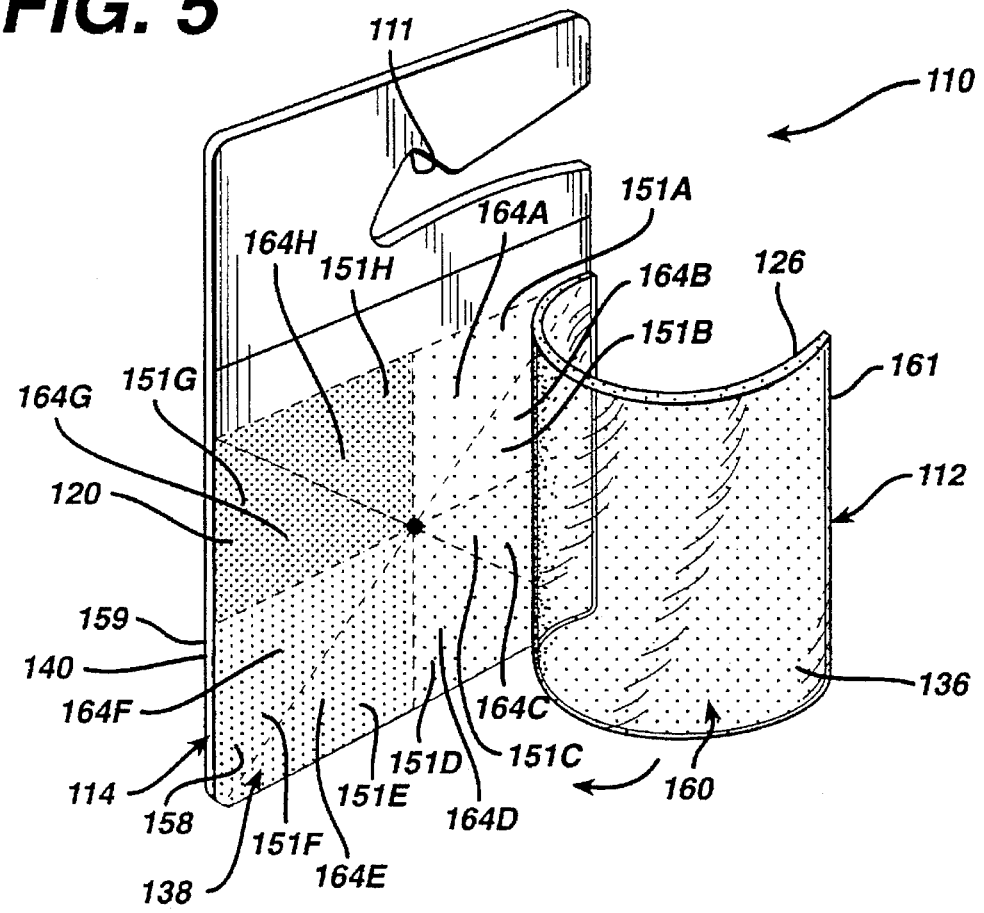
FIG. 5 is a perspective view of a parking time indicator according to the present invention.
Figure 6:
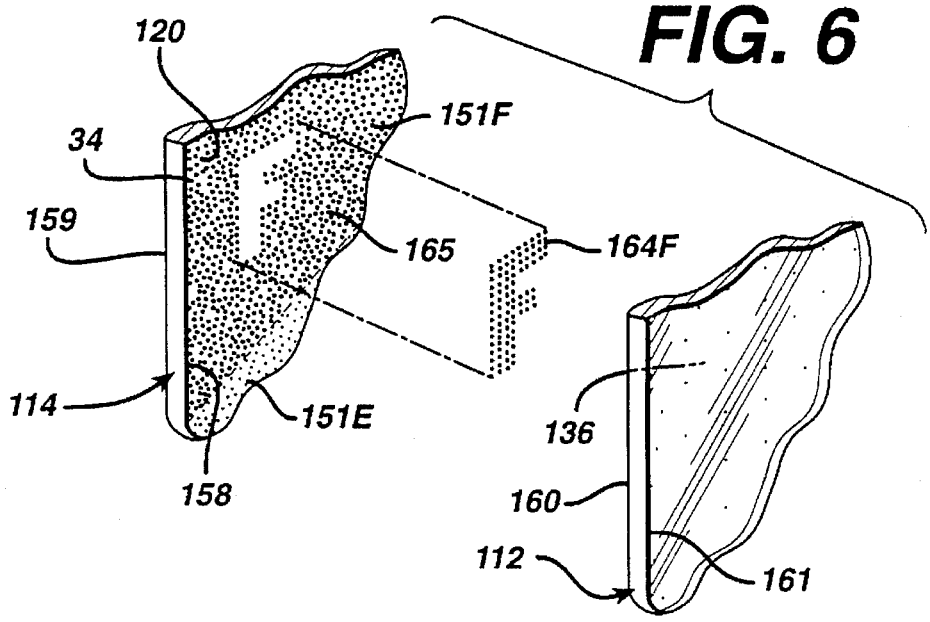
FIG. 6 is an exploded perspective view of a portion of the indicator of FIG. 5.
Figure 7:
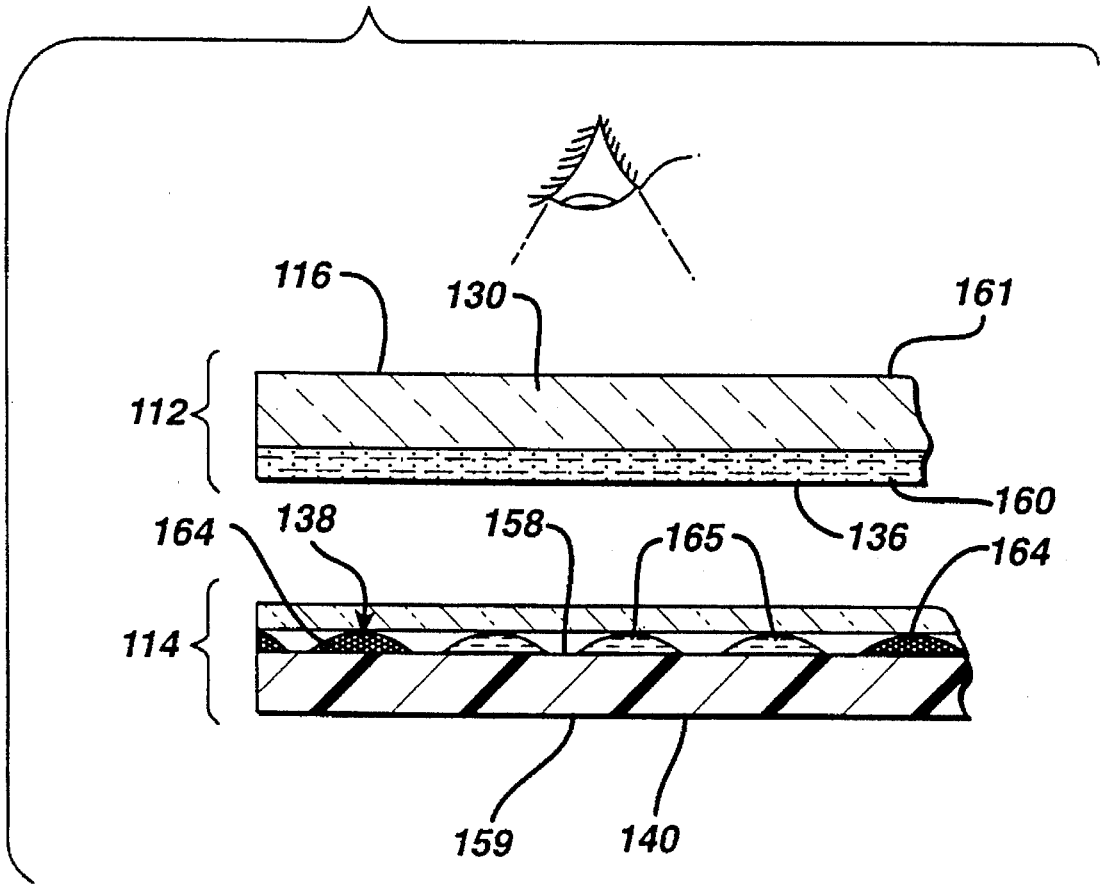
FIG. 7 is a schematic cross-section view of the time indicator of FIG. 5.

As shown in FIGS. 5–7, where similar reference numerals identify similar elements shown in the previous figures, another embodiment of the present invention comprises a parking permit or parking time indicator generally designated as 110, which may be conveniently hung from, for example, a rearview mirror of a car by slot 111 therein. The indicator 110 comprises a first part 114 having a base 140 which has first and second surfaces 158 and 159. Substrate 140 may be made of cardboard, plastic, or any other material suitable for its intended use. Substrate 140 has thereon at least two indicia areas on the first surface 158. This invention, however, contemplates any number of indicia areas. The parking permit depicted FIG. 5 has eight adjacent triangular indicia areas 151A–151H arranged in a clockwise pattern. Each indicia area is designed to indicate the passage of an amount of time.

Still referring to these figures, a second part or substrate 112 is provided which has first and second surfaces 160 and 161. In general, a first chemical agent or ink 138 is applied on each indicia area and a second chemical agent or barrier film 120 is applied over the first chemical agent 138. A third chemical agent or adhesive 136 is applied on the first surface 160 of the second substrate 112. When the first surfaces 158 and 160 of parts 114 and 112 overlay and in contact with each other the third chemical agent 136 coacts with the second chemical agent 120 to dissolve the barrier layer 120 over an extended period of time. After the barrier layer is breached, the third chemical agent 136 coacts with the first chemical agent 138 to dissolve the first chemical agent 138 to cause a visually perceptible change at the second surface 161 overlaying the first indicia area 151A, in a first time interval, and a visually perceptible change at the second surface 161 overlaying the second indicia area 151B in a second selected time interval.

The ink pattern provide in each of the indicia areas 151A–151H comprises a pattern of dots 164A–164H printed in a preselected pattern in each of the indicia areas. The use of the term "dot" includes not only the usual meaning of the word dot, i.e., a small round point, but also other type small points of ink print, for example, triangular, heart-shaped, etc.

An indicia area 151 may have an ink pattern 164 which is surrounded by a pattern of background dots 165, preferably the same color as the ink pattern 164, which do not develop or change over a period of time. Ink pattern 164 is preferably a soluble ink pattern which, when placed in contact with the adhesive 136, which includes a solvent for the soluble ink, dissolve the dots so that the dots of the pattern bleed into each other. The background dots 165 are printed with an insoluble ink and thus do not bleed together when in contact with the adhesive. Of course, migration of the soluble ink does not take place until the barrier layer is breached as herein discussed.

This is a new means of constructing a non-electronic color time indicator. Previous dye migration time indicators used a semi-permeable polymer barrier to retard the dye migration. The indicator of this invention uses an impermeable polymer barrier 20 which is progressively dissolved (made thinner) or made permeable by either reactive or non-reactive chemicals applied to the front side of the impermeable barrier 20 opposite the deposited colored dyes. When this barrier membrane 20 is breached, the color dyes rapidly flow through the barrier and become visible.

Importantly, the indicators of the present invention remain completely white (noncolored) throughout the entire timing process because no dye is involved in the timing mechanism. Only when the impermeable barrier is breached (becomes porous) does the dye flow and migrate to the side of the time indicator being viewed. This color change is very rapid and provide an immediate timing interval indication. To be specific, the timing process can be for weeks or months, yet the complete color change from white to 100% color can occur within hours. All previous non-electronic timing indicators involve the colored dyes or color forming dye materials (precursors) in the timing process, whereas the present invention does not involve any of the dye components in the actual timing mechanism. Liquid wick color indicators, oxidation of polymers, dye migration through semi-permeable barriers all involve the colored dye itself. This invention, conversely seals the dye out of sight and in a protect sealed state. When the timing mechanism barrier is ruptured, the dye escapes and migrates and flows throughout the visible area of the indicator.

The construction of the impermeable barrier and sealed dye area are basically the same for the time indicator. There are several different constructions of the activating medium. These are described below.

The colored dye used in the time indicator of the present invention is deposited on one side of an impermeable film barrier such as polystyrene. This film barrier must be able to be made porous by dissolving, by absorption of an organic liquid or by simple chemical reactions of additives that may be added to a pressure sensitive adhesive that will be placed into contact with the film to start the timing process.

In a first construction, the dye is red and the polystyrene barrier film hides the dye by being an opaque (white) film, or by having a white or opaque coating place on the lower side of the film, or by having the dye printed as a light dot pattern such as 10 or 20% tint on the lower side of the film.

When the barrier film is polystyrene, a simple nonreactive organic compound is dissolved in the adhesive. This organic compound is suitable for dissolving the barrier film. A suitable material is DOP. When the timing cover is placed on the polystyrene barrier film, the DOP slowly flows into the barrier film, dissolving it. As time passes, this barrier becomes thinner and thinner, but no dye contacts the adhesive activator because the film is still impermeable. Even a few thousand angstroms of material will keep the dye separated from the activator.

When the barrier film 20 is finally breached or made porous, the dye 38 passes through it rapidly and is immediately dissolved by the adhesive which is saturated with the DOP liquid, so that the indicator changes color almost immediately through the entire timing cover.

Since the polystyrene barrier film 20 is white or has a white coating applied to the lower surface thereof, so that barrier film 20 hides the dye 38, the indicator remains white until the dispersion of the dye 38 throughout the adhesive 36 in front of the barrier 20. This feature produces the most important benefit of this invention, since all other timing indicators using slow dye diffusion which causes a very gradual color change that makes it difficult to show the exact end of a time interval.

A second construction of the timing cover include a porus material such as filter paper or milipore filter material which is a highly porus cellulose that will absorb large volumes of liquid.

By using a porous material containing the organic compound one can provide the compound at a continuous rate to dissolve the film barrier. This porous material could be interleaved between a clear support film and a pressure sensitive adhesive which would serve as a means to attach it to the film barrier.

Preferably, the color changing backpart and the timing cover frontpart are stable and have a shelf life at ambient temperature of at least 2 years. Additionally, it is desirable that the assembly and construction materials are relatively inexpensive so that the indicator is relatively inexpensive. Further, the components of the indicator should be flexible and foodsafe because of application to edible, pharmaceutical and other consumer products.

The materials used in construction of the indicator should show relatively low temperature sensitivity in order to minimize the time-temperature effect. Typically, the indicator will be used at normal room temperature where the average ambient temperature range will be 70° to 85° F., and refrigerator temperature where the range will be 40° to 45° F.

Preferred inks for use with this invention are from Gans Ink Company, Los Angeles, Calif. In particular, Pyroscript Sublimation Inks, e.g. Ink Nos. 57977, 57976; Heat Transfer Inks, Turn-A-Bout, Sunrise Process, Sunburst Process and Turn-A-Bout R.S. Series inks. Sublimation and heat transfer type inks are generally low molecular weight dyes that can bleed. Standard inks which do not bleed include particles, i.e., finely ground non-migrating solids (vis-vis molecules) which provide deep colors.

Almost any adhesive which is receptive to the dyes and inks can be used. By adding polar and/or non-polar materials to the adhesive you can alter the absorption properties of the adhesive. Preferred adhesives are from Avery Company, Fasson Films Division, Painesville, Ohio.

The time indicator of this invention has many uses, including, but not limited to: a self-timing sticker for visual validation of an access card; a safety sticker that develops out warning words such as Dangerous after specific time intervals; a self-timing retail sticker that voids itself; a time temperature food spoilage indicator; an indicator sticker for biological industrial processes, laboratory experiments, field testing, etc. where a clock or timer is impractical or too expensive; a service sticker that shows words such as "Service Required" after a service or preventative maintenance time interval; a property pass, luggage tag, or barcoding sticker that self-expires to prevent re-use; a shipping sticker that changes color to flag urgent or dated shipments that are overdue or about to be missed; an i.d. admission bracelet that self-expires after a time interval; a ski ticket or entertainment park pass that self-expires; a tollbook, bus/train pass, that develops out the word expired after a specific time intervals.

Having thus described my invention in detail, it is to be understood that the foregoing description is not intended to limit the spirit and scope thereof. What is desired to be protected by Letters Patent as set forth in the appended claims.

What is claimed is:

1. A time indicator that rapidly changes color after a specific time interval, comprising:

a base substrate with a dissolvable colored dye deposited on a first surface;

a dye impermeable barrier applied over and in contact with the dissolvable colored dye; and a substrate having an adhesive on a first surface thereof, the substrate in adhesive contact with the dye impermeable barrier, the adhesive capable of dissolving the barrier in a predetermined time period;

wherein when the substrate and the base substrate are put into adhesive contact to activate the time indicator, the dye impermeable barrier prevents contact of the adhesive with the dissolvable colored dye and the adhesive coacts with the dye impermeable barrier to dissolve the barrier in the predetermined time interval, whereupon the adhesive contacts the dissolvable colored dye to dissolve the dye and permit the dye to migrate through the adhesive to cause a color change visible through the substrate in the predetermined time interval.

2. The apparatus of claim 1 wherein the predetermined time interval is at least about one month.

3. The apparatus of claim 1 wherein the predetermined time interval is at least about one year.

4. The apparatus of claim 1 wherein the predetermined time interval is at least about three months.

5. The apparatus of claim 1 wherein the time indicator is a security badge.

6. The apparatus of claim 5 further comprising a front print display surface having an indicia area for identifying a user of the badge.

7. A time indicator comprising:

a transparent front support layer with a front print display surface;

an ink display layer with the front ink display surface, the front ink display surface overlaying said support layer;

an opaque layer overlaying the ink display layer;

an ink dissolver layer overlaying the opaque layer;

a dye impermeable barrier overlaying and in adhesive contact with the ink dissolver layer, the ink dissolver capable of dissolving the barrier in a predetermined time period;

an ink layer overlaying the dye impermeable barrier layer, the ink layer including a migrating ink; and a back support layer overlaying the ink layer;

wherein when the dye impermeable barrier and the ink dissolver layer are put into adhesive contact to activate the time indicator, the dye impermeable barrier prevents contact of the ink dissolver layer with the ink layer and the ink dissolver layer coacts with the barrier to dissolve the barrier layer in a predetermined time interval whereupon the ink dissolver layer contacts the ink layer to cause the ink to migrate through the ink dissolver layer, through the opaque layer, through the ink display layer to the front ink display surface where it can be viewed through the front support member in the predetermined time interval.

8. The apparatus of claim 7 wherein the predetermined time interval is at least about one month.

9. The apparatus of claim 7 wherein the predetermined time interval is at least about one year.

10. The apparatus of claim 7 wherein the predetermined time interval is three months.

11. The apparatus of claim 10 wherein the indicator is a security badge.

12. The apparatus of claim 11, the front print display surface includes an indicia area for identifying a user of the badge.

13. A time indicator comprising:

a first substrate having first and second surfaces and at least one indicia area on the first surface;

a second substrate having first and second surfaces;

an ink pattern of dots printed in a preselected pattern in the at least one indicia area;

a dye impermeable barrier layer overlaying and in contact with the ink pattern of dots;

an adhesive activator means on the first surface of the second substrate in adhesive contact with the dye impermeable barrier layer, the adhesive activator capable of dissolving the barrier in a predetermined time period;

wherein, when the first surface of each substrate are put into adhesive contact to activate the time indicator and overlay each other, the impermeable barrier layer preventing contact of the adhesive with the dissolvable colored dye, the adhesive activator coacts with the dye impermeable dissolvable barrier layer to dissolve the dye impermeable dissolvable barrier layer in a predetermined time interval whereupon the adhesive activator contacts the ink pattern of dots and coacts with the ink pattern of dots to cause the ink pattern of dots to gradually bleed and blend together along the surface of the first substrate to cause a change visually perceptible through the second substrate overlaying the indicia area in the predetermined time interval.

14. The apparatus of claim 13 wherein the predetermined time interval is one month.

15. The apparatus of claim 13 wherein the predetermined time interval is two months.

16. The apparatus of claim 13 wherein the predetermined time interval is three months.

17. The apparatus of claim 14 wherein the time indicator is a parking permit.

18. The apparatus of claim 14 wherein the time indicator is a security badge.

19. The apparatus of claim 14 wherein the time indicator is a wrist band.

20. The apparatus of claim 14 wherein the time indicator is a self-expiring label.

21. A time indicator comprising:

a transparent front support layer;

an ink display layer overlaying said support layer;

an opaque ink dissolver layer overlaying the ink display layer;

a dye impermeable barrier overlaying and in adhesive contact with the opaque ink dissolver layer, the opaque ink dissolver layer capable of dissolving the barrier in a predetermined time period;

an ink layer including a migrating ink overlaying the impermeable barrier;

a back support layer overlaying the ink layer;

wherein when the dye impermeable barrier and the ink dissolver layer are put into adhesive contact to activate the time indicator, the dye impermeable barrier prevents contact of the ink dissolver layer with the ink layer, the opaque ink dissolver layer and the barrier coact to dissolve the barrier in a predetermined time interval whereupon the opaque ink dissolver layer contacts the ink layer to cause the ink to migrate through the opaque ink dissolver layer, to the ink display layer where it can be viewed through the front support member in the predetermined time interval.

22. The apparatus of claim 21 wherein the predetermined time interval is at least about one month.

23. The apparatus of claim 21 wherein the predetermined time interval is at least about one year.

24. The apparatus of claim 21 wherein the predetermined time interval is at least about three months.

* * * * *